US007224321B2

(12) United States Patent
Chiang et al.

(10) Patent No.: US 7,224,321 B2
(45) Date of Patent: May 29, 2007

(54) BROADBAND SMART ANTENNA AND ASSOCIATED METHODS

(75) Inventors: Bing A. Chiang, Melbourne, FL (US); Michael J. Lynch, Merritt Island, FL (US); Joseph T. Richeson, deceased, late of Melbourne, FL (US); by Dee M. Richeson, legal representative, Wood River, IL (US); Douglas H. Wood, Palm Bay, FL (US)

(73) Assignee: InterDigital Technology Corporation, Wilmington, DE (US)

( * ) Notice: Subject to any disclaimer, the term of this patent is extended or adjusted under 35 U.S.C. 154(b) by 0 days.

(21) Appl. No.: 11/190,745

(22) Filed: Jul. 27, 2005

(65) Prior Publication Data

US 2006/0022890 A1 Feb. 2, 2006

Related U.S. Application Data

(60) Provisional application No. 60/592,084, filed on Jul. 29, 2004.

(51) Int. Cl.
*H01Q 19/00* (2006.01)

(52) U.S. Cl. ..... 343/833; 343/700 MS; 343/810; 343/834

(58) Field of Classification Search ..... 343/833
See application file for complete search history.

(56) References Cited

U.S. PATENT DOCUMENTS

| | | | | |
|---|---|---|---|---|
| 3,846,799 | A | 11/1974 | Gueguen | 343/833 |
| 5,905,473 | A | 5/1999 | Taenzer | 343/834 |
| 6,288,682 | B1 * | 9/2001 | Thiel et al. | 343/702 |
| 6,369,770 | B1 | 4/2002 | Gothard et al. | 343/794 |
| 6,480,157 | B1 * | 11/2002 | Palmer et al. | 343/700 MS |
| 6,683,574 | B2 * | 1/2004 | Su | 343/700 MS |
| 6,876,331 | B2 * | 4/2005 | Chiang et al. | 343/702 |
| 6,888,504 | B2 * | 5/2005 | Chiang et al. | 343/702 |
| 2003/0146880 | A1 * | 8/2003 | Chiang et al. | 343/853 |
| 2004/0027304 | A1 * | 2/2004 | Chiang et al. | 343/810 |
| 2004/0046694 | A1 * | 3/2004 | Chiang et al. | 342/360 |
| 2004/0113851 | A1 * | 6/2004 | Gothard et al. | 343/702 |

OTHER PUBLICATIONS

Antenna Frequency Scaling: The ARRL Antenna Book, p. 2.24-2.25.*

Ohira et al., Electronically Steerable Passive Array Radiator Antennas for Low-Cost Analog Adaptive Beamforming, 0-7803-6345-0/00, 2000, IEEE.

(Continued)

*Primary Examiner*—Don Wong
*Assistant Examiner*—Binh Van Ho
(74) *Attorney, Agent, or Firm*—Allen, Dyer, Doppelt, Milbrath & Gilchrist, P.A.

(57) ABSTRACT

A smart antenna includes a ground plane, an active antenna element adjacent the ground plane, and passive antenna elements adjacent the ground plane. The passive antenna elements have different sizes for defining different resonant frequencies for increasing a bandwidth of the smart antenna. Dielectric layers having different dielectric constants may also be used for coating the passive antenna elements for defining different resonant frequencies. Impedance elements are connected to the ground plane and are selectively connectable to the passive antenna elements for antenna beam steering.

20 Claims, 8 Drawing Sheets

OTHER PUBLICATIONS

Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.

King, The Theory of Linear Antennas, pp. 622-637, Harvard University Press, Cambridge, Mass., 1956.

Lo et al., Antenna Handbook: Theory, Applications and Design, pp. 21-38, Van Nostrand Reinhold Co., New York, 1988.

* cited by examiner

BROADBAND SMART ANTENNA AND ASSOCIATED METHODS

RELATED APPLICATION

This application claims the benefit of U.S. Provisional Application Ser. No. 60/592,084 filed Jul. 29, 2004, the entire contents of which are incorporated herein by reference.

FIELD OF THE INVENTION

The present invention relates to the field of wireless communication systems, and more particularly, to a broadband smart antenna.

BACKGROUND OF THE INVENTION

In wireless communication systems, portable or mobile subscriber units communicate with a centrally located base station within a cell. The wireless communication systems may be a CDMA2000, GSM and WLAN communication system, for example. The subscriber units are provided with wireless data and/or voice services and can connect devices such as, for example, laptop computers, personal digital assistants (PDAs), cellular telephones or the like through the base station to a network.

Each subscriber unit is equipped with an antenna. To increase the communications range between the base station and the mobile subscriber units, and for also increasing network throughput, smart antennas may be used. Smart antennas may also be used with access points and client stations in WLAN communication systems. A smart antenna includes a switched beam antenna or a phased array antenna, for example, and generates directional antenna beams.

Example smart antennas are disclosed in U.S. Pat. Nos. 6,369,770 and 6,480,157. Both of these patents are assigned to the current assignee of the present invention, and are incorporated herein by reference in their entirety. Antennas in general have limited bandwidth, and smart antennas also exhibit this same behavior.

With the emergence of new wireless applications, there is a demand for smart antennas having a wider bandwidth than had been previously developed. A wider bandwidth often requires a more complex design, which could increase antenna loss. Alternatively, reactive components can be added to increase the bandwidth, but this adds to the cost of a smart antenna.

SUMMARY OF THE INVENTION

In view of the foregoing background, it is therefore an object of the present invention to increase the bandwidth of a smart antenna with minimum increases in antenna loss and costs.

This and other objects, features, and advantages in accordance with the present invention are provided by a smart antenna comprising a ground plane, an active antenna element adjacent the ground plane, and a plurality of passive antenna elements adjacent the ground plane. The passive antenna elements may have different sizes for defining a plurality of different resonant frequencies for increasing a bandwidth of the smart antenna. A plurality of impedance elements may be connected to the ground plane, and may be selectively connectable to the plurality of passive antenna elements for antenna beam steering.

The different sizes of the plurality of passive antenna elements may correspond to passive antenna elements with different heights. The different sizes of the plurality of passive antenna elements may also correspond to passive antenna elements with different widths.

The different size passive antenna elements are thus stagger-tuned passive antenna elements, which creates a series of different resonant frequencies for increasing a bandwidth of the smart antenna. A wider bandwidth is advantageously achieved while minimizing additional antenna loss and production costs.

The smart antenna may further comprise a dielectric substrate, and the active antenna element and the plurality of passive antenna elements are carried by the dielectric substrate. The smart antenna may also further comprise a plurality of switches for selectively connecting the plurality of passive antenna elements to the plurality of impedance elements.

Each impedance element may be associated with a respective passive antenna element. Each impedance element may comprise an inductive load and a capacitive load. The inductive load and the capacitive load may be selectively connectable to the respective passive antenna element.

In lieu of the different size passive antenna elements (i.e., the passive antenna elements are the same size), each passive antenna element may comprise a dielectric layer thereon, with the dielectric layers having different dielectric constants for defining a plurality of different resonant frequencies for increasing a bandwidth of the smart antenna. The dielectric layers having different dielectric constants may also be used on different size passive antenna elements. Alternatively, the spacing between the active elements may be varied to each of the passive elements.

Another aspect of the present invention is directed to a mobile subscriber unit comprising a smart antenna for generating a plurality of antenna beams, and a beam selector controller connected to the smart antenna for selecting one of the plurality of antenna beams. A transceiver may be connected to the beam selector and to the smart antenna. The smart antenna is as defined above.

Yet another aspect of the present invention is directed to a method for making a smart antenna as defined above with either the different size passive antenna elements, and/or the dielectric layers with different dielectric constants on the passive antenna elements for defining a plurality of different resonant frequencies for increasing a bandwidth of the smart antenna.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations are used to indicate similar elements in alternative embodiments.

Figure 1:
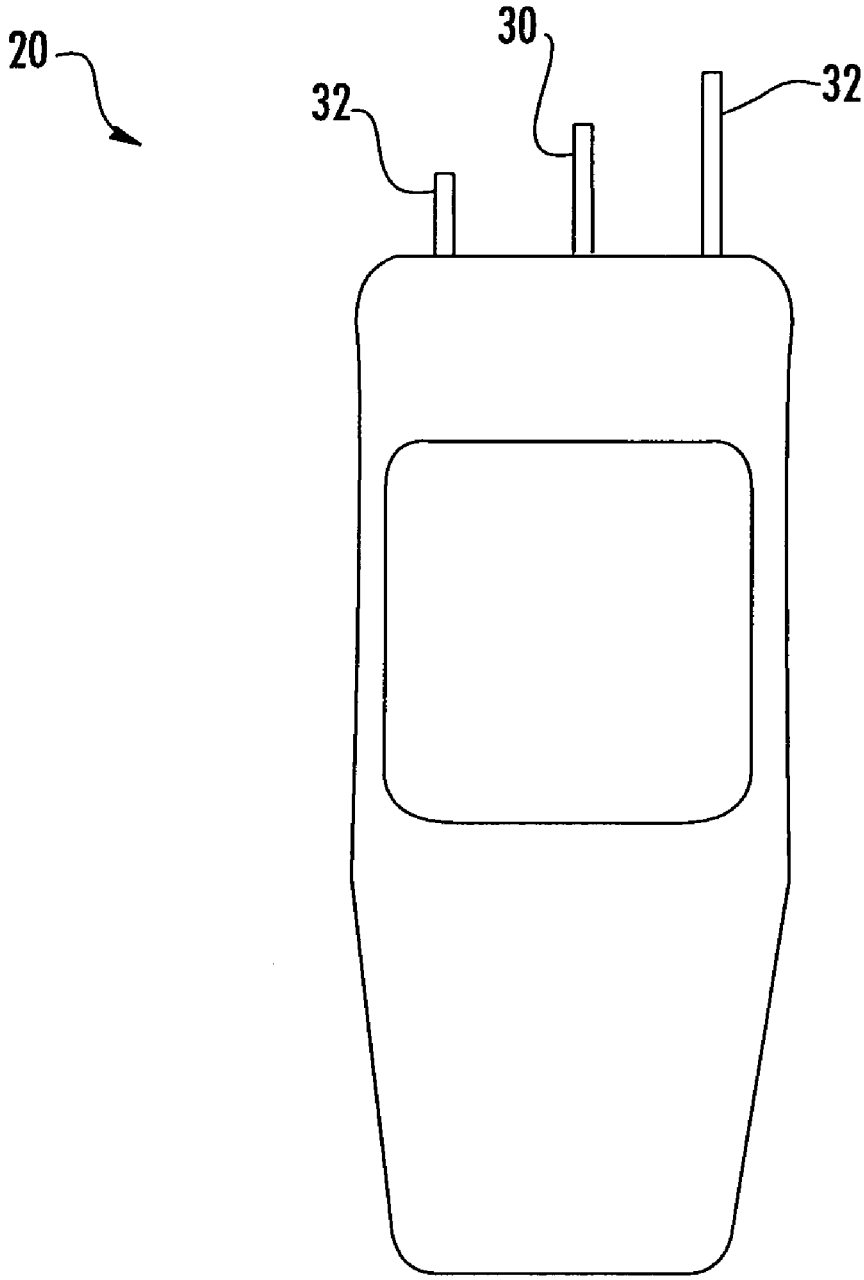
FIG. 1 is a schematic diagram of a mobile subscriber unit with a smart antenna in accordance with the present invention.
Figure 2:
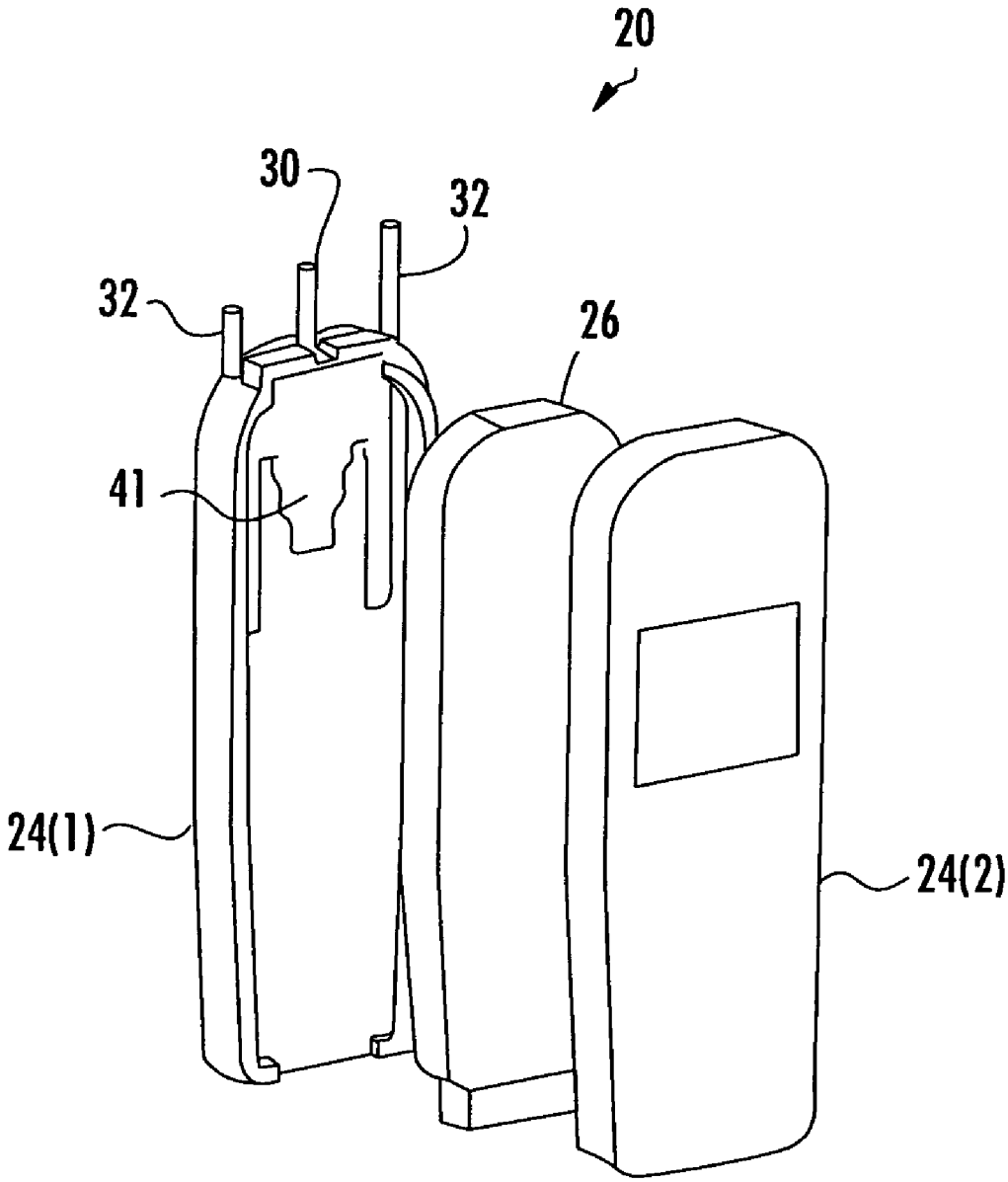
FIG. 2 is an exploded view illustrating integration of the smart antenna in the mobile subscriber unit shown in FIG. 1.
Figure 3:
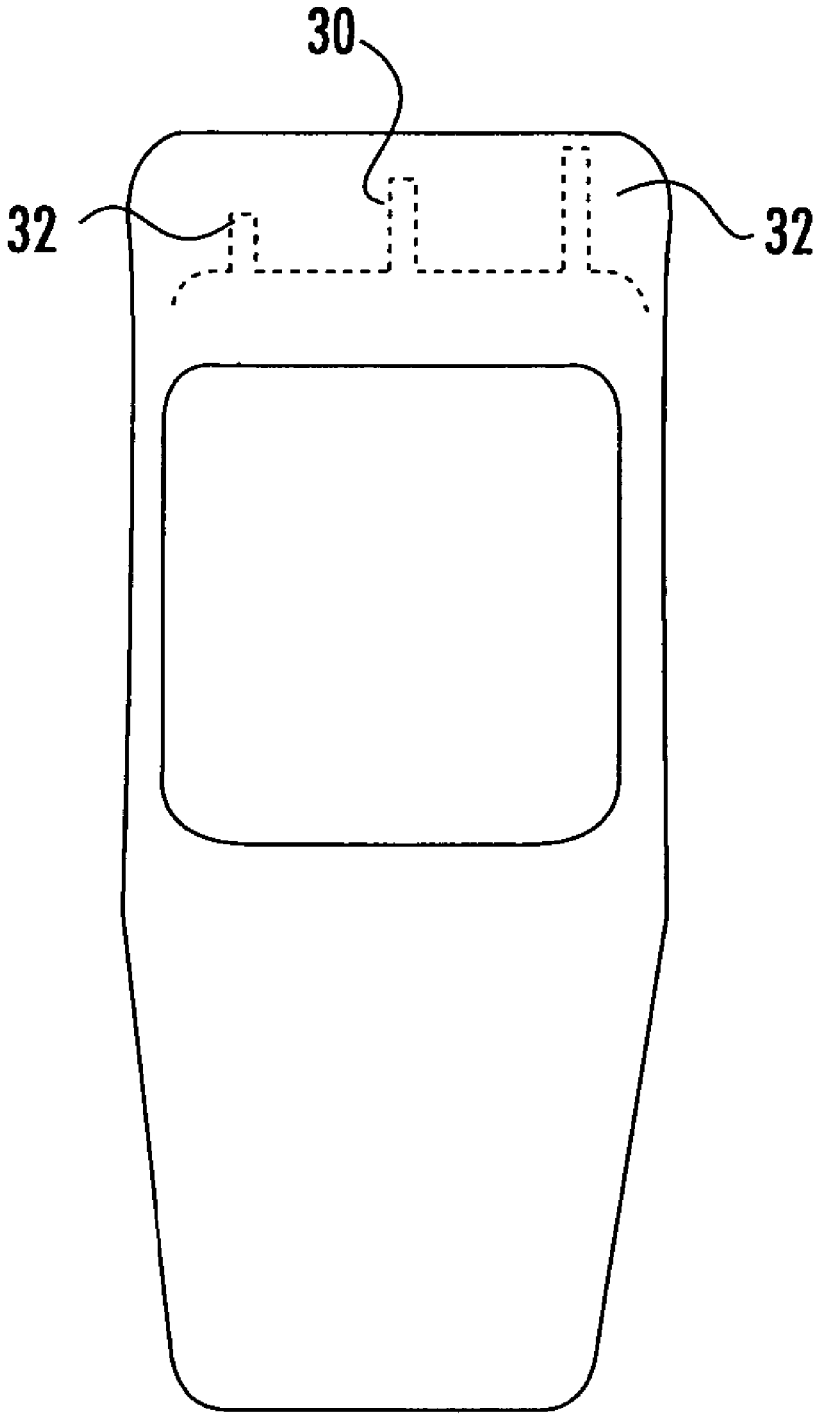
FIG. 3 is a schematic diagram of the smart antenna shown in FIG. 1 internal the mobile subscriber unit.
Figure 4:
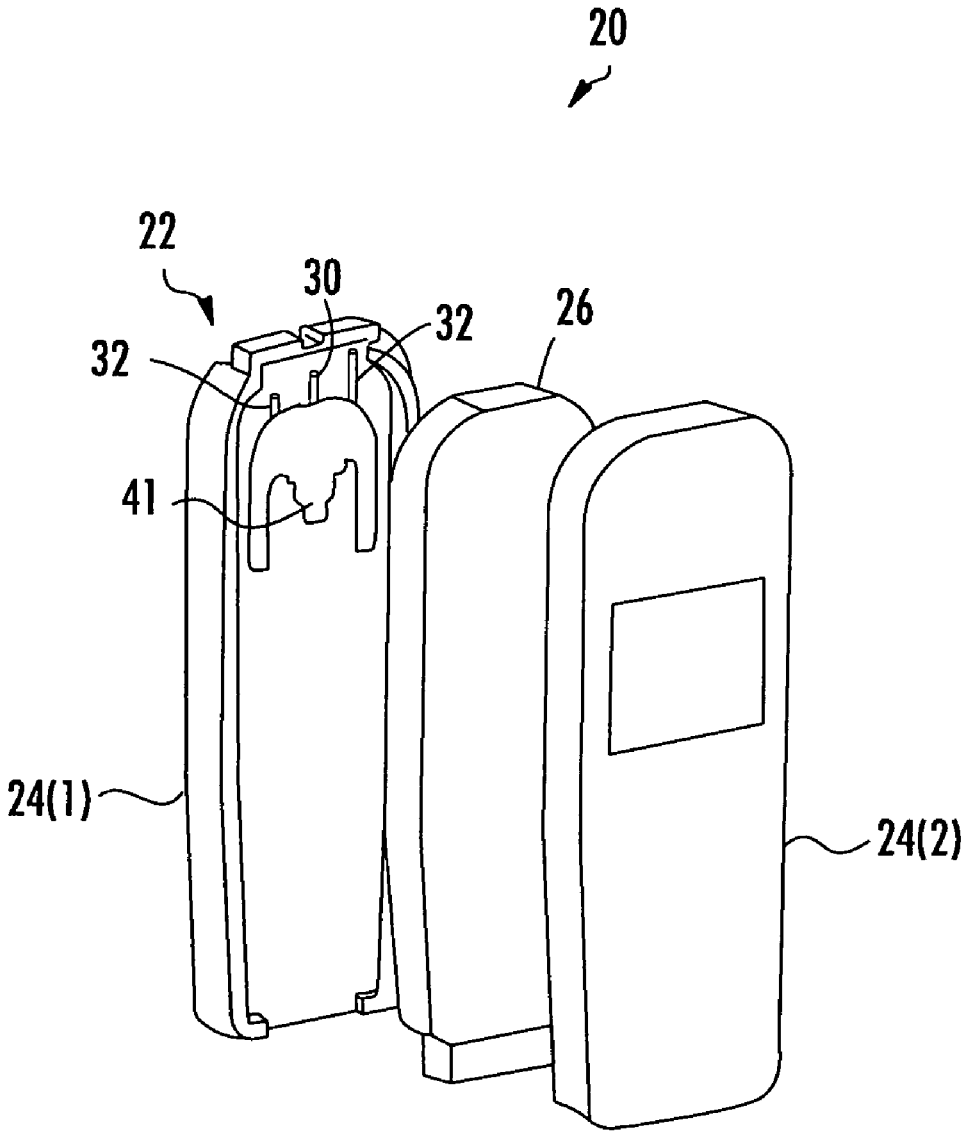
FIG. 4 is an exploded view illustrating integration of the smart antenna in the mobile subscriber unit shown in FIG. 3.

Referring initially to FIGS. 1–4, the illustrated mobile subscriber unit 20 includes in FIGS. 1 and 2 a smart antenna 22 that protrudes from the housing 24 of the mobile subscriber unit 20, and in FIGS. 3 and 4 a smart antenna that is internal the housing 24. In both cases, the smart antenna 22 includes an active antenna element 30 and a plurality of passive antenna elements 32.

The passive antenna elements 32 have different sizes for defining different resonant frequencies for the smart antenna 22. By defining different resonant frequencies, the bandwidth of the smart antenna 22 is advantageously increased. The different sizes of the passive antenna elements 32 may be due to different heights, widths and/or thicknesses.

As an alternative, dielectric materials having different dielectric constants may coat "same-size" passive antenna elements in order to define different resonant frequencies for the smart antenna 22. The different dielectric constants change the electrical characteristics of the passive antenna elements as if their heights, widths and/or thicknesses were changed. Of course, another configuration for defining different resonant frequencies for the smart antenna 22 is to coat "different-size" passive antenna elements 32 with dielectric materials having different dielectric constants.

The smart antenna 22 in accordance with the present invention provides for directional reception and transmission of radio communication signals with a base station in the case of a cellular handset, or from an access point in the case of a wireless data unit by making use of wireless local area network (WLAN) protocols.

In the exploded view of FIGS. 2 and 4 illustrating integration of the smart antenna 22 into the mobile subscriber unit 20, the smart antenna is formed on a printed circuit board and placed within a rear housing 24(1) of the mobile subscriber unit. A center module 26 may include electronic circuitry, radio reception and transmission equipment, and the like. An outer housing 24(2) may serve as, for example, a front cover of the mobile subscriber unit 20. When the rear and outer housings 24(1), 24(2) are connected together, they form the housing 24 of the mobile subscriber unit 20.

The printed circuit board implementation of the smart antenna 22 can easily fit within a handset form factor. In an alternate embodiment, the smart antenna 22 may be formed as an integral part of the center module 26 or of part of 24(1) or 24(2), resulting in the smart antenna and the center module being fabricated on the same printed circuit board. The ground portion 41 of the smart antenna 22 is embedded inside the housing 24.

Figure 5:
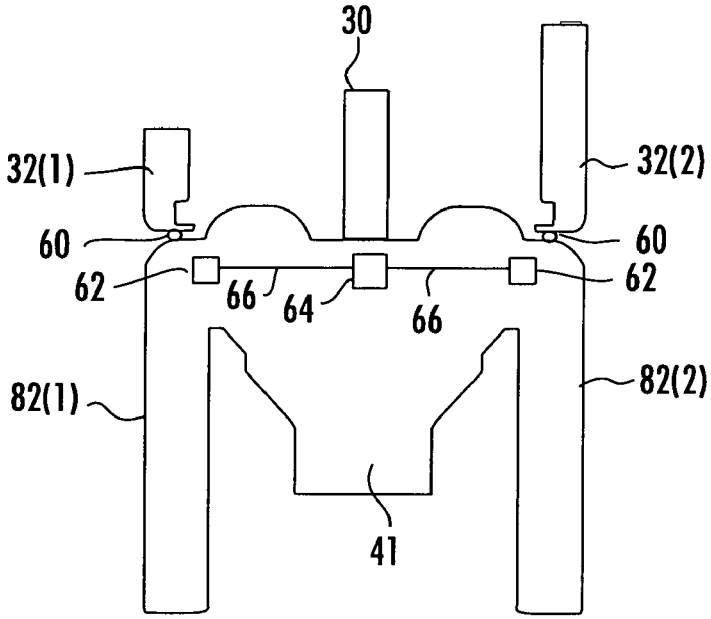
FIG. 5 is a schematic diagram of the smart antenna shown in FIGS. 1–4.
Figure 6:
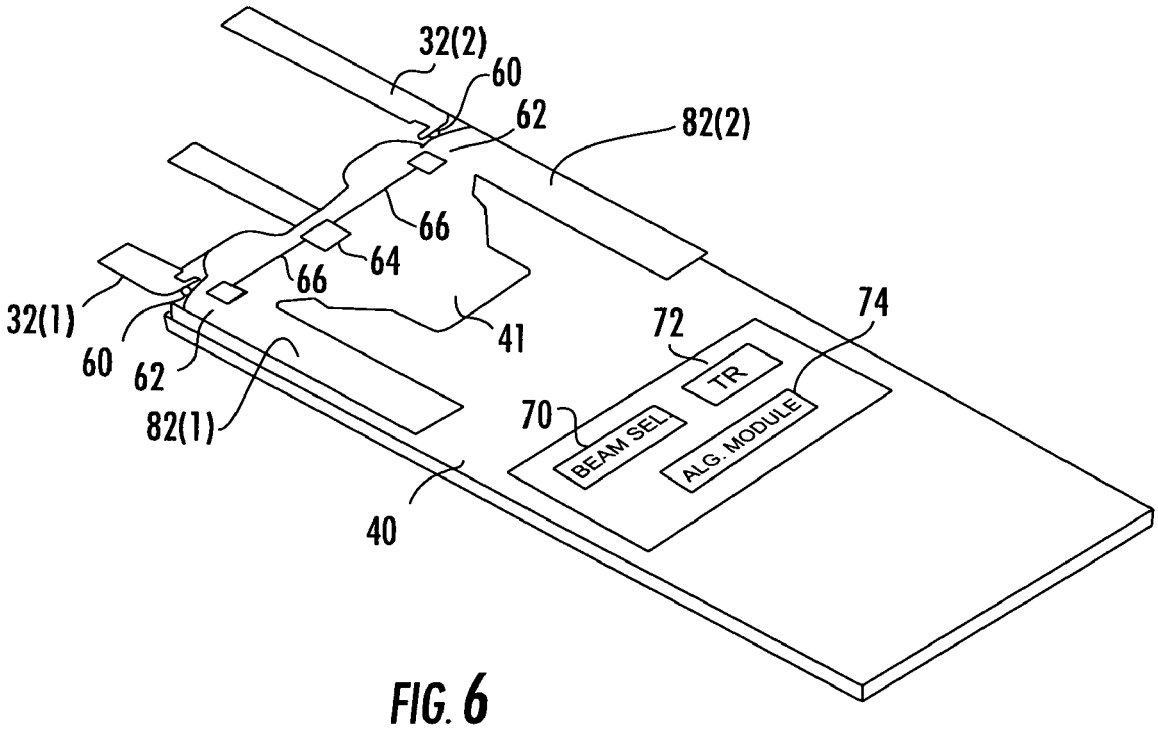
FIG. 6 is a schematic diagram of the smart antenna shown in FIG. 5 on a dielectric substrate in close proximity to other handset circuitry.

The smart antenna 22 may be disposed on a dielectric substrate 40 such as a printed circuit board, including the center active antenna element 30 and the outer passive antenna elements 32, as illustrated in FIGS. 5 and 6. Each of the passive antenna elements 32 can be operated in a reflective or directive mode.

The active antenna element 30 comprises a conductive radiator disposed on the dielectric substrate 40. The passive antenna elements 32 are also disposed on the dielectric substrate 40 and are laterally adjacent the active antenna element 30.

To increase or broaden the bandwidth of the smart antenna 22, the heights of the passive antenna elements 32 are selected so that they are different from one another. The heights of the passive antenna elements 32 are approximately one-quarter the wavelength of the operating frequency of the smart antenna 22, which is the height of the active antenna element 30. When the passive antenna elements 32 all have the same height, they in turn all have the same resonant frequency.

In the illustrated embodiment, the heights of the passive antenna elements 32 are selected so that the resonant frequencies of the passive antenna elements are different from one another. Slight variations in the resonant frequencies cause the bandwidth of the smart antenna 22 to increase.

The heights of the passive antenna elements 32 may be varied in multiples of one-eighth or one-sixteenth the wavelength of the operating frequency, for example. Of course, other multiples may be selected as long as different resonant frequencies are defined.

For example, the height of the passive antenna element 32(1) is slightly less than the height of the active antenna element 30, whereas the height of the passive antenna element 32(2) is slightly greater than the height of the active antenna element. As an example, the height of the passive antenna element 32(1) is three-eighths the wavelength of the operating frequency, and the height of the passive antenna element 32(2) is five-eighths the wavelength of the operating frequency. The height of the active antenna element 30 is one-fourth the wavelength of the operating frequency.

If there was a third passive antenna element, then its height could be the same as the active antenna element 30. Alternatively, the height of a third passive antenna element may be less than three-eighths or greater than five-eighths the wavelength of the operating frequency.

By changing the height of the passive antenna elements 32, the corresponding resonant frequency for each passive antenna element is also changed. The passive antenna elements 32 in turn affect the induced resonance of the active antenna element 30. By staggering the resonant frequencies of the passive antenna elements 32, the overall bandwidth of the smart antenna 22 is broadened.

Figure 7:
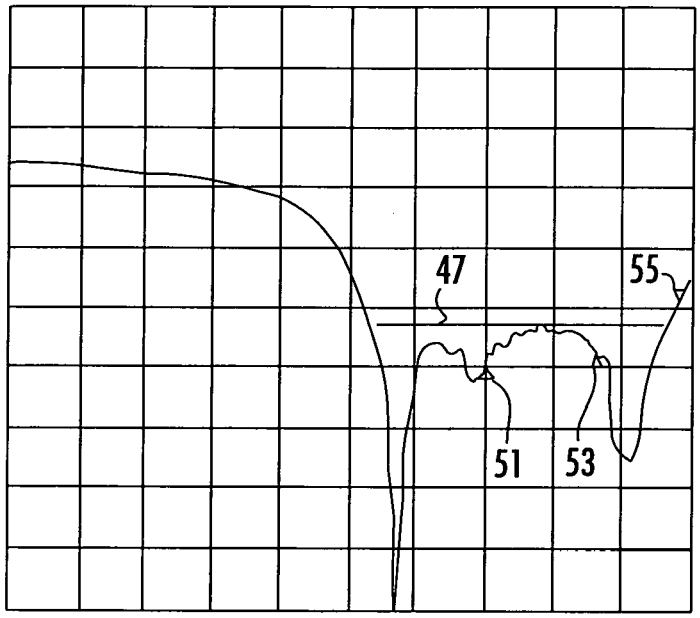
FIG. 7 is a graph illustrating the operating bandwidth for the smart antenna in accordance with the present invention.

The measured result of a smart antenna 22 operating over a frequency range of 1.5 to 2 GHz within the PCS frequency band with stagger-tuned passive antenna elements 32 is provided in FIG. 7. The bandwidth of the smart antenna 22 as indicated by markers 51, 53 and 55 was increased by 70%. The stagger-tuned passive antenna elements 32 create a series of low-return loss dips in the frequency sweep of the smart antenna 22 to broaden the bandwidth, as indicated by line 47. A wider bandwidth is advantageously achieved without incurring additional antenna loss, nor increasing production costs.

Figure 8:
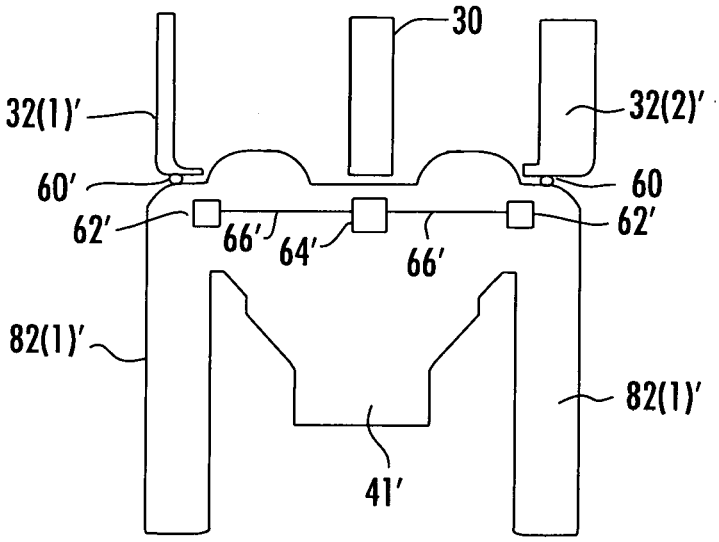
FIG. 8 is a schematic diagram of another embodiment of the smart antenna shown in FIG. 5.
Figure 9:
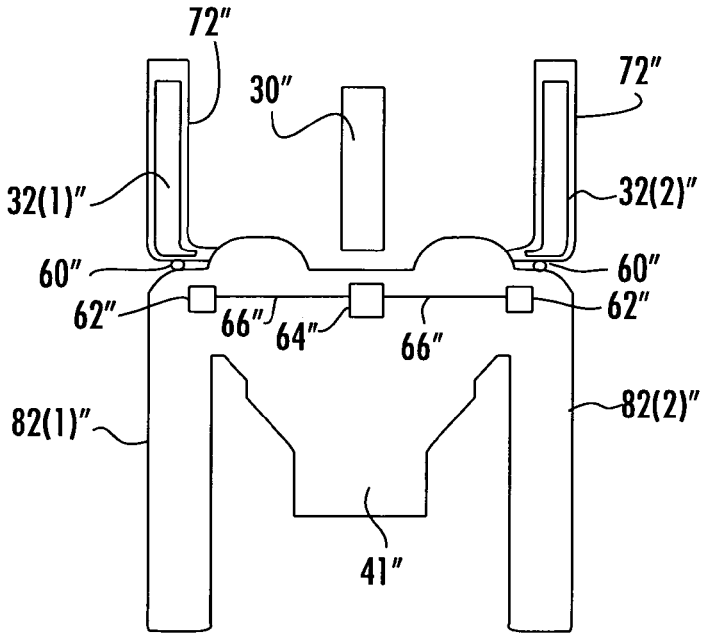
FIG. 9 is a schematic diagram of yet another embodiment of the smart antenna shown in FIG. 5.

In lieu of varying the height of the passive antenna elements 32, other changes include changing the widths/thicknesses while the heights remain the same, as illustrated in FIG. 8. The width/thickness of the passive antenna element 32(1)' is a narrow as compared to the width/thickness of the active antenna element 30'. The width/thickness of the passive antenna element 32(2)' is a thick as compared to the width/thickness of the active antenna element 30'. A combination of different heights and widths/thicknesses may also be selected for changing the resonant frequencies of the passive antenna elements 32', as readily appreciated by those skilled in the art.

Yet another embodiment for changing the resonant frequencies of the passive antenna elements is to coat or place adjacent the passive elements 32" a dielectric material 72" in which different dielectric constant materials are used. Dielectric materials having different dielectric constants are readily known by those skilled in the art. The different dielectric constants change the electrical characteristics of the passive antenna elements 32" without actually changing their sizes.

Alternatively, dielectric materials with different dielectric constants may also be used with different size passive antenna elements 32". The material loading of the dielectric material 72" of the passive antenna elements 32" thus causes property changes of the passive antenna elements so that they alter the passband characteristics of the smart antenna 22" or induce additional resonance that broaden the total band by adding to the original bandwidth.

Figure 10:
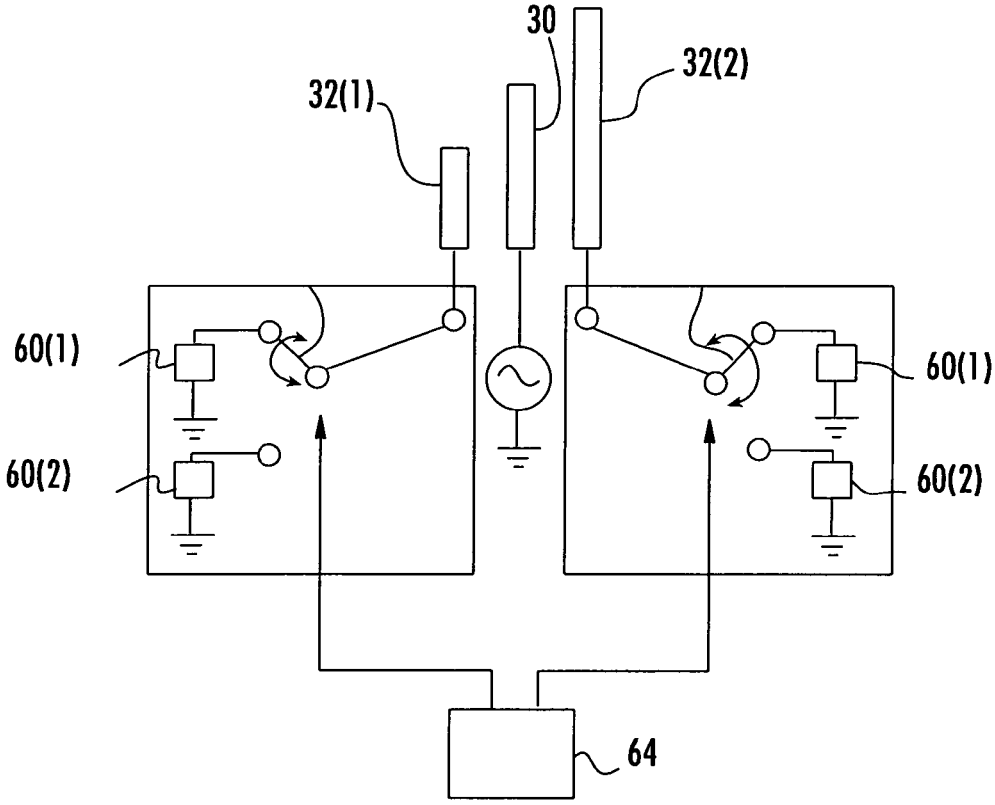
FIG. 10 is a schematic diagram of the switch and impedance elements for the passive antenna elements in accordance with the present invention.

The smart antenna 22 will now be discussed in greater detail while referring to FIGS. 5 and 10, for example. The active antenna element 30 and the passive antenna elements 32 are preferably fabricated from a single dielectric substrate such as a printed circuit board with the respective elements disposed thereon. The antenna elements 30, 32 can also be disposed on a deformable or flexible substrate The passive antenna elements 32 each have an upper conductive segment 32(1), 32(2) as well as a corresponding lower conductive segment 82(1), 82(2). Capacitive and inductive loads 60(1), 60(2) are at the feed points of the passive antenna elements 32 for antenna beam steering.

The lower conductive segments 82(1) and 82(2) can also be adjusted to provide staggered-tuning. In other words, the length, width, thickness and dielectric loading can be changed to create an offset resonant frequency for staggered-tuning just like the staggered-tuning of the upper conductive segments 32(1) and 32(2).

Gain is expected to be reduced or increased when the height of the upper half of a passive antenna element is other than one-quarter the wavelength of the operating frequency. In some size constrained cases, this gain reduction may be acceptable to meet packaging requirements. However, a variety of techniques can be used to reduce this loss. In particular, the length of the embedded portion, i.e., the lower conductive elements 82(1) and 82(2), can be increased to compensate for the reduced height.

This in effect turns the passive antenna elements 32 into offset fed dipoles. The passive antenna elements 32 are used to perform as a reflector/director element with controllable amplitude and phase. There is no input impedance for a reactive load 60 to match. In fact, a lossless mismatch is desired so the length change and offset feeding do not hinder performance of the smart antenna 22, as long as the loads 60 are low loss and the mismatch phase can be controlled.

For a passive antenna element 32 to operate in either a reflective or directive mode, the upper conductive segment 32(1) is connected to the corresponding lower conductive segment 82(1) via at least one impedance element 60. The at least one impedance element 60 comprises a capacitive load 60(1) and an inductive load 60(2), and each load is connected between the upper and lower conductive segments 32(1)/82(1) and 32(2)/82(2) via a switch 62. The switch 62 may be a single pole, double throw switch, for example.

When the upper conductive segment 32(1) is connected to a respective lower conductive segment 82(1) via the inductive load 60(1), the passive antenna element 32 operates in a reflective mode. This results in radio frequency (RF) energy being reflected back from the passive antenna element 32 towards its source.

When the upper conductive segment 32(1) is connected to a respective lower conductive segment 82(1) via the capacitive load 60(2), the passive antenna element 32 operates in a directive mode. This results in RF energy being directed toward the passive antenna element 32 away from its source.

A switch control and driver circuit 64 provides logic control signals to each of the respective switches 62 via conductive traces 66. The switches 62, the switch control and driver circuit 64 and the conductive traces 66 may be on the same dielectric substrate 40 as the antenna elements 30, 32.

As noted above, electronic circuitry, radio reception and transmission equipment, and the like may be on the center module 26. Alternatively, this equipment may be on the same dielectric substrate 40 as the smart antenna 22. As illustrated in FIG. 6, this equipment includes a beam selector 70 for selecting the antenna beams, and a transceiver 72 coupled to a feed 68 of the active antenna element 30.

An antenna steering algorithm module 74 runs an antenna steering algorithm for determining which antenna beam provides the best reception. The antenna steering algorithm operates the beam selector 70 for scanning the plurality of antenna beams for receiving signals.

Figure 11:
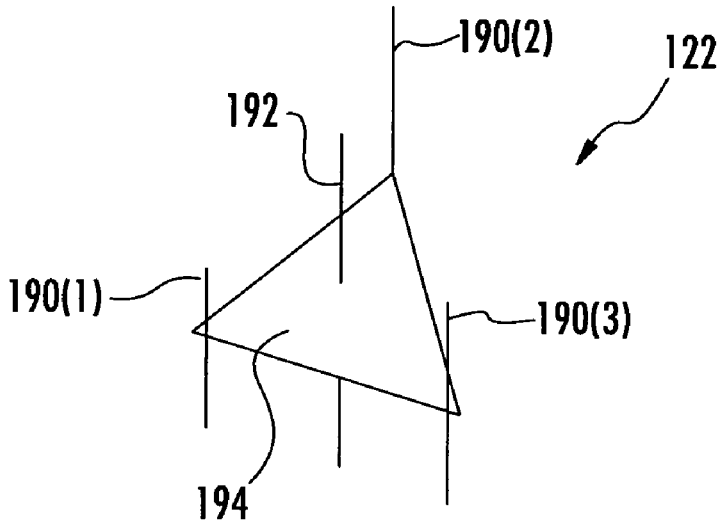
FIG. 11 is a perspective view of another embodiment of a smart antenna in accordance with the present invention.

Different embodiments of the smart antenna will now be discussed with reference to FIGS. 11–12. One embodiment of the smart antenna 122 comprises four antenna elements 190, 192 placed on a planar triangular ground plane 194, as illustrated in FIG. 11. Three of the antenna elements 190(1), 190(2) and 190(3) are placed on the corners of the triangular ground plane 194 and one of the antenna elements 192 is placed at the center point of the triangular ground plane. The illustrated shape of the ground plane 194 and the illustrated number of antenna elements 190, 192 may vary depending on the intended applications, as readily appreciated by those skilled in the art.

In one form of a switched beam antenna, the 3 outer antenna elements 190(1), 190(2) and 190(3) are passive and the center antenna element 192 is active. The passive elements 190(1), 190(2) and 190(3) act together with the active element 192 to form an array. In accordance with the present invention, the height of at least two of the passive antenna elements are different from one another in order to stagger the resonant frequencies of the illustrated smart antenna 122.

To alter the radiation pattern, the termination impedances of the passive elements 190(1), 190(2) and 190(3) are switchable to change the current flowing in these elements. The passive elements 190(1), 190(2) and 190(3) become reflectors when shorted to the ground plane 194 using pin diodes, for example. When the passive elements 190(1), 190(2) and 190(3) are not shorted to the ground pane 194, they have little effect on the antenna characteristics.

In another embodiment, the antenna elements 190, 192 are all active elements and are combined with independently adjustable phase shifters to provide a phased array antenna. In this embodiment, multiple directional beams as well as an omni-directional beam in the azimuth direction can be generated.

Essentially, the phased array antenna includes multiple antenna elements and a like number less one of adjustable phase shifters, each respectively coupled to one of the antenna elements. The phase shifters are independently adjustable (i.e., programmable) to affect the phase of respective downlink/uplink signals to be received/transmitted on each of the antenna elements.

A summation circuit is also coupled to each phase shifter and provides respective uplink signals from the subscriber device to each of the phase shifters for transmission from the subscriber device. The summation circuit also receives and combines the respective downlink signals from each of the phase shifters into one received downlink signal provided to the subscriber device 20.

The phase shifters are also independently adjustable to affect the phase of the downlink signals received at the subscriber device 20 on each of the antenna elements. By adjusting phase for downlink link signals, the smart antenna 122 provides rejection of signals that are received and that are not transmitted from a similar direction as are the downlink signals intended for the subscriber device 20.

Figure 12:
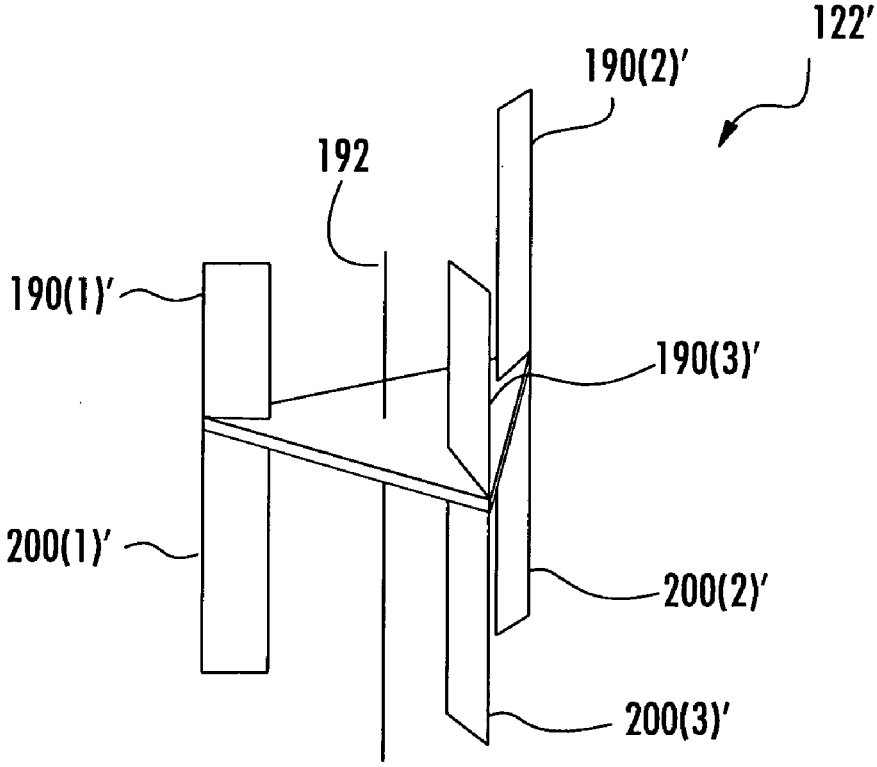
FIG. 12 is a perspective view of yet another embodiment of a smart antenna in accordance with the present invention.

Another embodiment of the smart antenna 122' is illustrated in FIG. 12 where the three antenna elements 190(1)', 190(2)' and 190(3)' placed at the corners of the triangular ground plane 194' have independently adjustable reactive load elements in the upper and lower halves of the antenna elements. The upper halves of the antenna elements are represented by references 190(1)', 190(2)' and 190(3)', wherein the corresponding lower halves are represented by references 200(1)', 200(2)' and 200(3)'. Such an embodiment can provide a plurality of beams that are directional in azimuth and/or elevation.

The independently adjustable reactive load elements include varactors or mechanically insertable RF choke elements, for example, to provide asymmetrical loading on the antenna elements. This results in antenna beams being formed that are directional in elevation.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A smart antenna comprising:

a ground plane;

an active antenna element adjacent said ground plane;

a plurality of passive antenna elements adjacent said ground plane, each passive antenna element comprising a dielectric layer thereon, with the dielectric layers having different dielectric constants for defining a plurality of different resonant frequencies for increasing a bandwidth of the smart antenna; and a plurality of impedance elements connected to said ground plane and being selectively connectable to said plurality of passive antenna elements for antenna beam steering.

2. A smart antenna according to claim 1 wherein said plurality of passive antenna elements have different sizes.

3. A smart antenna according to claim 2 wherein the different sizes of said plurality of passive antenna elements correspond to passive antenna elements with different heights.

4. A smart antenna according to claim 2 wherein the different sizes of said plurality of passive antenna elements correspond to passive antenna elements with different widths.

5. A smart antenna according to claim 1 further comprising a dielectric substrate; and wherein said active antenna element and said plurality of passive antenna elements are carried by said dielectric substrate.

6. A smart antenna according to claim 1 further comprising a plurality of switches for selectively connecting said plurality of passive antenna elements to said plurality of impedance elements.

7. A smart antenna according to claim 6 wherein each impedance element is associated with a respective passive antenna element, each impedance element comprising an inductive load and a capacitive load, with said inductive load and said capacitive load being selectively connectable to the respective passive antenna element.

8. A smart antenna according to claim 1 wherein each passive antenna element further comprises a first elongated portion connected to a respective impedance element.

9. A smart antenna according to claim 8 wherein each first elongated portion comprises a dielectric layer thereon, with the dielectric layers having different dielectric constants for defining the plurality of different resonant frequencies for increasing the bandwidth of the smart antenna.

10. A mobile subscriber unit comprising:

a smart antenna for generating a plurality of antenna beams;

a beam selector controller connected to said smart antenna for selecting one of said plurality of antenna beams; and a transceiver connected to said beam selector and to said smart antenna;

said smart antenna comprising a ground plane, an active antenna element adjacent said ground plane, a plurality of passive antenna elements adjacent said ground plane, each passive antenna element comprising a dielectric layer thereon, with the dielectric layers having different dielectric constants for defining a plurality of different resonant frequencies for increasing a bandwidth of the smart antenna, and a plurality of impedance elements connected to said ground plane and being selectively connectable to said plurality of passive antenna elements for antenna beam steering.

11. A mobile subscriber unit according to claim 10 further comprising a dielectric substrate; and wherein said active antenna element and said plurality of passive antenna elements are carried by said dielectric substrate.

12. A mobile subscriber unit according to claim 10 further comprising a plurality of switches for selectively connecting said plurality of passive antenna elements to said plurality of impedance elements.

13. A mobile subscriber unit according to claim 12 wherein each impedance element is associated with a respective passive antenna element, each impedance element comprising an inductive load and a capacitive load, with said inductive load and said capacitive load being selectively connectable to the respective passive antenna element.

14. A method for making a smart antenna comprising:

forming an active antenna element adjacent a ground plane;

forming a plurality of passive antenna elements adjacent the ground plane, each passive antenna element comprising a dielectric layer thereon, with the dielectric layers having different dielectric constants for defining a plurality of different resonant frequencies for increasing a bandwidth of the smart antenna; and forming a plurality of impedance elements connected to the ground plane and being selectively connectable to the plurality of passive antenna elements for antenna beam steering.

15. A method according to claim 14 wherein the plurality of passive antenna elements have different sizes.

16. A method according to claim 15 wherein the different sizes of the plurality of passive antenna elements correspond to passive antenna elements with different heights.

17. A method according to claim 15 wherein the different sizes of the plurality of passive antenna elements correspond to passive antenna elements with different widths.

18. A method according to claim 14 wherein the smart antenna further comprises a dielectric substrate; and wherein the active antenna element and the plurality of passive antenna elements are carried by the dielectric substrate.

19. A method according to claim 14 wherein the smart antenna further comprises a plurality of switches for selectively connecting the plurality of passive antenna elements to the plurality of impedance elements.

20. A method according to claim 19 wherein each impedance element is associated with a respective passive antenna element, each impedance element comprising an inductive load and a capacitive load, with the inductive load and the capacitive load being selectively connectable to the respective passive antenna element.

* * * * *